United States Patent [19]

Shafer et al.

[11] Patent Number: 4,480,555

[45] Date of Patent: Nov. 6, 1984

[54] DOUBLE ACTING RAILWAY CAR STABILIZING CYLINDER

[75] Inventors: James E. Shafer, Leoti; Earl M. Ford, Hutchinson, both of Kans.

[73] Assignee: The Cessna Aircraft Company, Wichita, Kans.

[21] Appl. No.: 5,545

[22] Filed: Jan. 22, 1979

[51] Int. Cl.[3] ..... B61F 3/08; B61F 5/24; B61F 5/50

[52] U.S. Cl. ..... 105/199 R; 105/175 A; 105/182 R; 105/197 D; 188/318

[58] Field of Search ..... 105/182 R, 200, 201, 105/174, 175 A, 197 D, 199 R; 188/317, 318; 92/169

[56] References Cited

U.S. PATENT DOCUMENTS

| | | | |
|---|---|---|---|
| 2,015,757 | 10/1935 | Moulton | 188/317 |
| 2,040,262 | 5/1936 | Kruckenberg et al. | 105/210 X |
| 3,443,528 | 5/1969 | Lipsius et al. | 105/174 X |
| 3,719,153 | 3/1973 | Schumacher | 105/200 X |
| 3,722,920 | 3/1973 | Reese | 188/318 X |
| 3,967,707 | 7/1976 | Carlton | 188/318 X |
| 4,192,225 | 3/1980 | Moyer | 92/169 |
| 4,228,741 | 10/1980 | Bruner | 105/182 R X |

*Primary Examiner*—Howard Beltran
*Attorney, Agent, or Firm*—Edward L. Brown, Jr.

[57] ABSTRACT

A hydraulic stabilizing device utilized to dampen the sway of railway cars comprising a double acting hydraulic cylinder having a center position wherein the fluid is locked in the opposing chambers of the cylinder except for high pressure relief once the piston is forced out of the center position as the railway car traverses a curve. Longitudinal groove means in the cylinder barrel opens up a restricted bypass across the cylinder piston so as to allow a conventional dampening function at all other positions of the cylinder except the center position. The stabilizer cylinder also includes a concentrically spaced sleeve surrounding the cylinder forming a precharged accumulator chamber for resupplying either of the cylinder chambers through check valves in the cylinder heads.

6 Claims, 3 Drawing Figures

DOUBLE ACTING RAILWAY CAR STABILIZING CYLINDER

FIELD OF THE INVENTION

The present invention relates to hydraulic dampening devices for use on railway cars.

BACKGROUND OF THE INVENTION

The most important factor which limits the speed of present day freight trains is not so much the curves in the roadbed as was true in the earlier days, but rather the misalignment of the tracks. Over the past thirty years most railroads have been forced to cut down on their efforts spent in maintaining the alignment of their tracks. Consequently most of their roadbeds and tracks have gradually gotten badly out of alignment merely due to the passage of trains thereacross. Once a track is seriously out of alignment, the speed at which a train may travel on those tracks without leaving the track is diminished. Rather than improving the problem by increasing the maintenance effort to maintain the tracks in better alignment, most railroads have been forced to merely slow the speeds of their trains across those misaligned tracks. When the freight cars are fully loaded, the problems of side-sway due to badly aligned tracks is not as severe as the situation with empty cars. Trains speeds with empty cars must be substantially reduced on poorly aligned tracks from those speeds when fully loaded because the empty cars have a greater tendency to side-sway and jump the track. The newer jumbo-sized railroad cars further compound this problem to the point where some empty trains must literally crawl across certain sections of track to prevent the cars from severe side-sway and ultimate derailment.

SUMMARY OF THE INVENTION

The present invention has attempted to relieve this problem of side-sway mentioned above, by the utilization of a large shock-absorbing cylinder attached between the car frame and truck. Since the tracks of a railway car are swivel-mounted to the car frame so as to accommodate curves in the track, the functions of a shock-absorbing cylinder become more complex.

The stabilizing cylinder of the present invention performs two different functions, depending upon its position. In the center position, wherein the railway car is traveling on essentially straight track, the stabilizing cylinder hydraulically locks its piston and rod against any movement with the exception of high pressure loads which are relieved across relief valves in the piston. In the center position, the stabilizing cylinder basically locks the trucks' angular position straight down the track regardless of the irregularities in the roadbed. Whenever the cars commence to negotiate a curve, the truck is slowly rotated relative to the car frame, forcing the stabilizer piston to move out of its center position and relieve high pressure oil across the piston relief valve to the opposite chamber. While this initial movement provides substantial resistance, once the piston has moved slightly off its center position, bypass passages will then open up across the cylinder piston allowing the piston rod to more freely move with the dampening effect being provided by the restriction of the oil flowing across the grooves in the cylinder barrel. Once in the off-center position to either side, the stabilizer cylinder provides a dampening function preventing any rapid movement of the car truck relative to the car frame.

DESCRIPTION OF THE PRIOR ART

The U.S. patent to Reese U.S. Pat. No. 3,722,920, teaches the concept of grooves in the cylinder wall to provide bypass flow for dampening and shock-absorbing. Also, the idea of variable dampening depending on the stroke position, is taught in U.S. Pat. No. 3,967,707. The present invention is unique from any of these references in that it utilizes a center position which hydraulically locks the stabilizer piston in place rather than utilizing a variable cross section orifice, depending upon piston position.

It is therefore the principal object of the present invention to provide a new and improved two-stage stabilizer cylinder usable on railroad cars.

Another object of the present invention is to provide a stabilizer cylinder including an integral accumulator and reservoir for replacing rod leakage.

BRIEF DESCRIPTION OF THE DRAWINGS

The invention will become more readily apparent from the following description of the preferred embodiment thereof shown in the accompanying drawing in which.

DESCRIPTION OF THE PREFERRED EMBODIMENT

Figure 1:
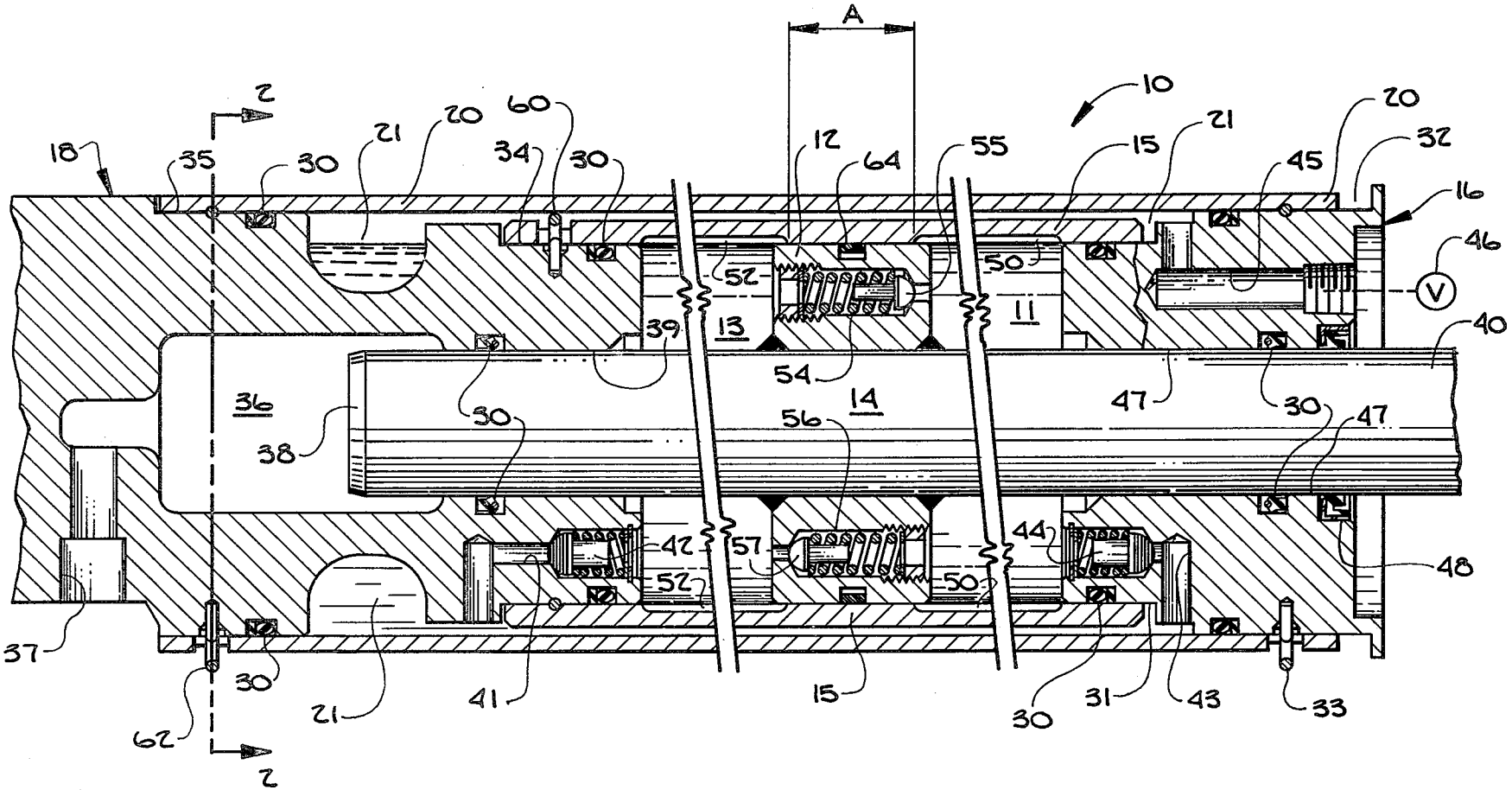
FIG. 1 is a partial longitudinal section with portions of the length of the cylinder broken away to conserve space.
Figure 2:
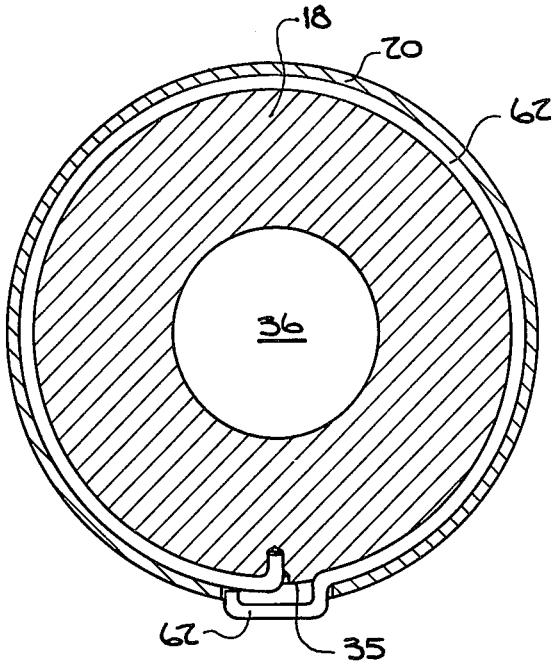
FIG. 2 is a sectional view taken along line 2—2 of FIG. 1.

With reference to the drawings, the stabilizing cylinder is generally referred to by reference numeral 10. The double acting cylinder 10 includes a piston 12 attached to a double-ended rod 14 by means of welding or any other conventional form. Piston 12 is slidably positioned in a cylinder barrel 15 which is closed at each end by heads 16 and 18 thereby defining right and left cylinder chambers 11 and 13, respectively. Concentrically positioned around cylinder barrel 15 is a sleeve 20 which is also closed at each end by heads 16 and 18 respectively. Defined between sleeve 20 and barrel 15 is an accumulator chamber 21. Head 16 includes a first flanged surface 31 having an appropriate diameter for snug insertion in the end of barrel 15. Cut in the periphery of flange 31 is a conventional o-ring groove and seal 30 for sealing the right hand cylinder chamber 11. Also located on head 16 is a second flanged surface 32 of a slightly larger diameter for receipt in the end of sleeve 20. Head 16 is locked into axial engagement with sleeve 20 by a removable locking wire 33, shown in detail in U.S. Pat. No. 4,192,225.

Figure 3:
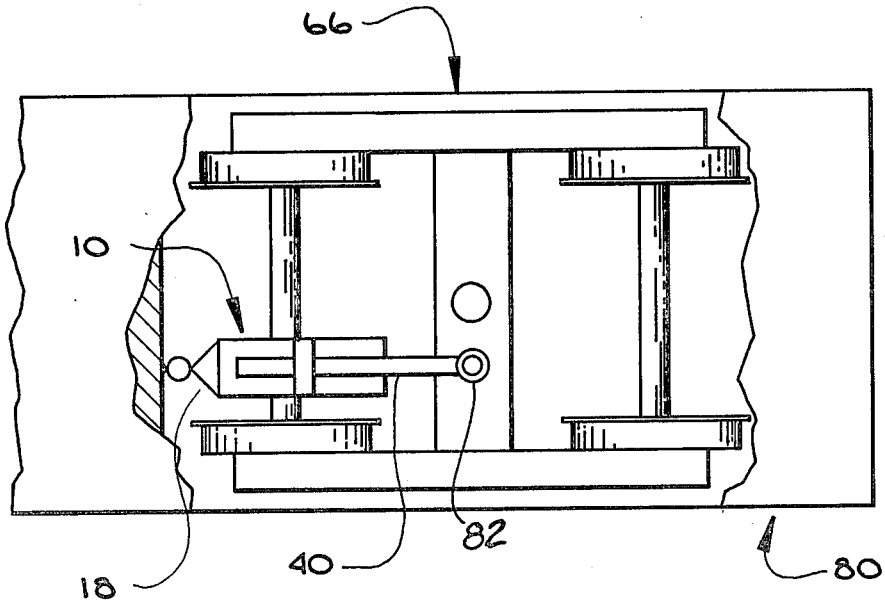
FIG. 3 is a schematic plan view of the location of the stabilizing cylinder on a railway car.

Head 18 located at the left end of the stabilizer cylinder 10 includes a first flanged surface 34 for receipt in the left end of cylinder barrel 15. Also located on head 18 is a second flanged surface 35 of a slightly larger diameter which is snugly received in the end of sleeve 20. Flanged surfaces 34 and 35 both have conventional o-ring grooves and seals 30 located in the periphery thereof to sealingly enclose the left end of cylinder chamber 13 and left end of accumulator chamber 21. Head 18 also includes a removable locking wire 60 positioned between the outer circumference of surface 34 and inner diameter of barrel 15, as described in detail in the above-mentioned patent application. Head 18 is also held in axial locking engagement with sleeve 20 by similar locking wire 62, as mentioned above. Also located in head 18 is a rod extension cavity 36 vented to atmosphere through passage 37. Entering the right hand end of extension cavity 36 is a bore 39 sized for receipt of the left hand end 38 of rod 14. A conventional o-ring groove and seal 30 is also provided in bore 39 to seal chamber 13 from cavity 36. The right hand end 40 of piston rod 14 is broken away in FIG. 1 to conserve space, but located at its outward end as shown somewhat schematically in FIG. 3 is a conventional clevis 82 of a type well-known in the trade. Located in the bottom area of head 18 is a passage 41 which includes a check valve 42 connecting accumulator chamber 21 with the left hand cylinder chamber 13. Check valve 42 prevents fluid from flowing out of chamber 13 while allowing fluid to flow into chamber 13 from the accumulator chamber 21. Head 16 includes a similar passage 43 between accumulator chamber 21 and the right hand cylinder chamber 11. Positioned in passage 43 is a check valve 44 preventing flow from cylinder chamber 11 into accumulator chamber 21. Located in the upper portions of head 16 is a charging passage 45 including some form of valve means 46 threadably received in the outer end thereof. Passage 45 connects with the upper areas of accumulator chamber 21 for charging with oil and air under pressure. Head 16 also includes a bore 47 sized for passage of piston rod 14 including a conventional groove and o-ring seal 30 cut in the inner periphery of bore 47. Located at the outer extremity of bore 47 is a conventional wiping ring 48. Head 16 is not lockingly engaged with cylinder barrel 15 at flange 31 due to the locking engagement between sleeve 20 and heads 16 and 18. Locking wire 60 attaching the left end of cylinder barrel 15 to head 18 does not carry any axial loads, but rather accurately positions barrel 15 relative to piston 12.

Located on the inside surface of cylinder barrel 15 are a plurality of longitudinally extending grooves 50 which extend from the right hand end of cylinder barrel 15 to approximately the middle thereof. A similar matching set of grooves 52 extend from the left hand end of barrel 15 to the center area of the barrel providing therebetween an ungrooved portion A of the barrel. As long as the piston 12 is in the ungrooved area, no fluid can flow across the orifices defined by grooves 50 or 52. This ungrooved area is defined as the center or locked position.

Piston 12 includes a lateral passage 54 thereacross which accommodates an adjustable relief valve 55 for allowing high pressure fluid to relieve from right hand chamber 11 into left hand chamber 13 under high pressure conditions. Located in the bottom portion of piston 12 is a similar lateral passage 56 including a similar relief valve 57 allowing high pressure fluid to relieve in the opposite direction from left hand chamber 13 into right hand chamber 11. The relieving pressure of relief valves 55 and 57 can be adjusted in accordance with the requirements of the system. Piston 12 also includes a conventional packing ring and seal package 64 located in the center of the piston 12.

OPERATION

Head 18 of the stabilizing cylinder 10 is connected to some stationary portion of the railroad car frame as illustrated in FIG. 3, while the rod end 40 of the cylinder is connected to some portion of the rotatably mounted conventional truck 66. In most instances, the railroad car 80 will be traveling on essentially straight track with the stabilizing cylinder 10 in its center or locked position, as illustrated in FIG. 1. In this locked position, truck 66 is prevented from hunting by any oscillating motion due to lateral misalignment of the tracks.

As the railroad car 80 begins to traverse a curved portion of the track, the truck 66 slowly rotates on its pivot point causing piston rod 14 to move to either the right or to the left, building pressure in either cylinder chamber 11 or 13. If, for example, cylinder rod 14 attempts to move to the right, the pressure in chamber 11 will build to that level which relief valve 55 is set. The relief fluid passes through lateral passage 54 to the opposing cylinder chamber 13. Any further movement of piston 12 to the right is accommodated by relieving pressure until piston seal 64 passes the end of groove 50. At this point piston 12 is at the far right edge of its center position and secondary flow passages across the piston are about to open through grooves 50. At this point, the high pressure in chamber 11 drops as flow is allowed to cross piston 12 in grooves 50. The cross section of grooves 50 are sized to allow a shock-absorbing effect whenever the piston 12 attempts to move at a rapid rate. Once the piston 12 is out of its center position A, the cylinder functions as a conventional shock-absorber with the longitudinal grooves 50 or 52 providing the orificing means for resisting any rapid movement of piston 12. As for example, if the train car 80 is on a curved portion of the track when it encounters some alignment irregularity, the stabilizing cylinder 10 will still stabilize any rotational oscillations of the car-truck 66 due to the orificing effect of fluid flowing across either grooves 50 or grooves 52. The rate of change of a railroad curve or spiral at normal train speeds is sufficiently slow to allow piston 12 to move without creating any resistance due to the orificing effect of oil flowing across either grooves 50 or 52.

The center position A of stabilizing cylinder 10 comprises a small portion of the overall cylinder stroke amounting to approximately ten percent. Cylinder 10 has substantially greater length than shown in FIG. 1 since portions of the cylinder are broken away to conserve space. Whenever cylinder 10 is in its center position, which is most of the time, a greater resistance is imparted towards any rotational movement of truck 66 than is provided once the piston 12 moves off its center position and allows bypassing fluid to flow across either grooves 50 or 52.

Any leakage of oil from either chamber 11 or 13 across the seals 30 on either end of rod 14 is made up for by the oil in accumulator chamber 21. Chamber 21 is partially filled with oil and charged with air pressure through passage 45 and valve 46. The oil level in accumulator chamber 21 is always maintained above the openings of passages 43 and 41 so that if any oil escapes along the rod from either chamber 11 or chamber 13, respective check valves 42 or 44 could open allowing recharged fluid in chamber 21 to make up for the leakage.

Having described the invention with sufficient clarity to enable those familiar with the art to construct and use it, I claim:

1. An oscillation restraint device for a railway vehicle including a vehicle body and a wheel truck rotatable with respect to the body, said device comprising:

a hydraulic cylinder mounted on a first member of the vehicle;

a piston disposed within the cylinder to divide the cylinder into first and second chambers and coupled to a second member of the vehicle such that rotation of the wheel truck with respect to the vehicle body causes the piston to move along the interior of the cylinder;

a substantially incompressible hydraulic fluid contained in the cylinder;

bypass passage means interconnecting first and second portions of the cylinder such that fluid is free to travel between the first and second chambers when the piston is in a first predetermined range of positions, corresponding to truck orientation for travel along curved track, and fluid is substantially prevented from traveling through the bypass passage between the first and second chambers when the piston is in a second predetermined range of positions, corresponding to truck orientation for travel along substantially straight track;

a first pressure relief valve disposed within the piston to pass fluid from the first chamber to the second chamber when the pressure in the first chamber exceeds a predetermined value;

a second pressure relief valve disposed within the piston to pass fluid from the second chamber into the first chamber when the pressure in the second chamber exceeds a predetermined value;

said piston, cylinder, fluid, bypass passage means and first and second valves automatically cooperating to substantially block the flow of fluid between the first and second chambers when the piston is in the second predetermined range of positions, and thereby to hydraulically lock the wheel truck so as to substantially prevent all wheel truck oscillations when the first and second valves are closed.

2. A double acting stabilizer cylinder utilized between the truck and frame of a railroad car for preventing hunting due to oscillation motion comprising:

a double ended cylinder rod carrying a piston;

a cylinder barrel containing the rod and piston defining two cylinder chambers;

a pair of heads each closing an end of the barrel including openings therein for receipt and passage of opposing ends of the cylinder rod;

a sleeve concentrically positioned over the barrel defining a precharged accumulator chamber for receipt of both oil and air under pressure, said heads also closing the ends of the accumulator chamber;

check valve means in the bottom of the accumulator chamber between the accumulator chamber and at least one of the cylinder chambers;

relief valve means in the piston allowing high pressure oil in each cylinder chamber to pass to the other cylinder chamber;

at least one pair of longitudinal groove means on the inside surface of the cylinder barrel extending from both ends of the barrel inward toward the center with each groove terminating at a point approximate the center of the cylinder providing a longitudinal distance between the ends of the grooves which is less than fifteen percent of the overall cylinder stroke, whereby in the center position the cylinder rod and piston are hydraulically locked against movement until sufficient pressure is built up to open the relief valve means.

3. A double acting stabilizer cylinder as set forth in claim 2, wherein one end of the cylinder rod includes a clevis means and the cylinder head at the opposite end from the clevis includes a vented cavity for receipt of the opposite end of the cylinder rod.

4. A double acting stabilizer cylinder as set forth in claim 2, wherein each cylinder head includes a pair of concentrically spaced locking flanges for receipt and engagement with the ends of the cylinder barrel and sleeve and removable locking means positioned at each flange for releasably locking each cylinder head to the ends of the cylinder barrel and sleeve.

5. A double acting stabilizer cylinder as set forth in claim 2, including a cavity in one cylinder head for receipt of the cylinder rod and clevis means attached to the opposite end of the cylinder rod and double flange means on each head of the cylinder for locking engagement with both the cylinder barrel and sleeve.

6. A double-acting stabilizer cylinder as set forth in claim 5, including removable locking means positioned at one flange of each head for releasably locking each cylinder head to the ends of the sleeve whereby the longitudinal load on the cylinder is carried by the sleeve.

* * * * *